US005495694A

United States Patent [19]

Kuhns

[11] Patent Number: 5,495,694

[45] Date of Patent: Mar. 5, 1996

[54] DEFLECTOR ASSEMBLY FOR A RAIN GUTTER

[76] Inventor: Richard L. Kuhns, 210 Broad St., Red Bank, N.J. 07701

[21] Appl. No.: 301,543

[22] Filed: Sep. 6, 1994

[51] Int. Cl.[6] ..... E04D 13/00

[52] U.S. Cl. ..... 52/12; 52/11

[58] Field of Search ..... 52/11, 12, 13, 52/14, 15; 210/474; 248/48.1, 48.2

[56] References Cited

U.S. PATENT DOCUMENTS

| | | | |
|---|---|---|---|
| 2,271,081 | 1/1942 | Layton | 248/48.2 X |
| 4,497,146 | 2/1985 | Demartini | 52/12 |

FOREIGN PATENT DOCUMENTS

| | | | |
|---|---|---|---|
| 005874 | 3/1994 | WIPO | 52/11 |

*Primary Examiner*—Creighton Smith
*Attorney, Agent, or Firm*—Thomason & Moser

[57] ABSTRACT

An improved deflector assembly for a rain gutter comprising a top portion for extending from a roof line and having a distal edge located over a rain gutter; an arcuate portion, formed along the distal edge of the top portion and extending toward the rain gutter, having a curvature for carrying rain water from the top portion into the rain gutter; a bracket, attached between the top portion and the rain gutter, for supporting the top portion above the rain gutter; and the top portion having a first end and a second end each containing two attachment apertures proximate thereto, a first attachment aperture having a smaller diameter than a second attachment aperture, the top portion being attached to the bracket using the first attachment aperture. The brackets are either a gutter lip mounting bracket that supports the deflector from the gutter lip or a rear mount bracket that supports the deflector from the rear wall of the rain gutter.

29 Claims, 6 Drawing Sheets

DEFLECTOR ASSEMBLY FOR A RAIN GUTTER

BACKGROUND OF THE INVENTION

1. Field of Invention

The present invention relates to a covering and deflector for existing rain gutters and roof-lines and, more particularly, to an improved deflector assembly for channeling rain water into a rain gutter.

2. Description of the Prior Art

U.S. Pat. Nos. 4,404,775 and 4,796,390 (which are hereby incorporated by reference), issued to Demartini, describe a deflector assembly which consists of a flat main portion and a curved or arcuate portion located between the main portion and a lower edge. The assembly is positioned above a rain gutter such that the lower edge is located between a front edge and a rear wall of the gutter, and the curved portion is of sufficiently large radius as to extend beyond a trough portion of the gutter and cause water traversing the main portion to be caused, by surface tension, to follow around the curved portion and leave the curved portion at the lower edge. The main portion is held in place with a bracket having a substantially straight upper section and a reverse-curved, downwardly oriented lower section, including upward facing tabs in the upper section and downward facing tabs in the lower section to receive the upper edge of an associated rain gutter.

In principle, water coming from the roof flows onto the main portion of the deflector assembly following its path to the arcuate surface where, through principles of surface adhesion, water will adhere to the surface and be delivered into the gutter as the debris carried by the water is jettisoned off of the arcuate surface. However, difficulties ensue because of how the arcuate portion of the deflector device is attached to the gutter and held in place. Typically, clips, such as those described in the prior art, e.g., in the U.S. Pat. No. '390 Demartini patent, are used to hold the deflector assembly in position above the gutter. The bracket consists of a lower portion which is curved in a reversed direction to the curve of an upper portion. The lower portion is designed to rest on an upper edge of the outside wall of the gutter and is affixed via tabs to an inside lip of the gutter. The brackets are often secured to the gutter by bending the bracket down the outside wall of the gutter thus pulling the tab tight to the inside lip of the gutter. The difficulty with brackets of this type are that they are not fully stationary at the gutter-bracket juncture. Consequently, to facilitate a stable deflector assembly, the top edge of the flat portion of the deflector assembly must be made stationary to the roof via a combination of adhesive strips and by placing nails through the main portion into the roof. Such attachment to the roof prevents horizontal and/or vertical movement from wind and storms which could cause the deflector assembly to be blown off the gutter. The drawbacks of this arrangement are that the adhesive strip increases the cost and time required for installation. Additionally, the nail that is required to make the panel stationary simply introduces one more location on each panel, typically in 3- to 5-foot lengths, wherein water can enter through the shingles into the roof and potentially cause in-wall leaks and destruction of the roof itself. The other limitations of these types of assemblies are that the tabs used to affix the flat portion of the deflector to the bracket are made of aluminum and easily break off. Thus, whenever the flat main portion of the assembly must be removed for maintenance purposes, the brackets must be replaced. Another limitation is that these deflector assemblies have to be installed by trained technicians and often require two installers to align and attach the assembly to the roof.

Additionally, whenever the deflector assembly has to be removed from the gutter and roof for maintenance or replacement because of fallen tree limbs and the like, any fasteners or nails having been used to affix the flat portion of the covering to the roof must be removed, and replacing them during reinstallation further increases chances of causing a water pathway through the shingles and into the structure itself. Additionally, seal strips often used in the installation of this type of deflector often remove the grit from the shingles when the deflectors are removed. If deflectors are not replaced, an unsightly tell-tale blemish is left on the roofing where the seal strip was removed.

Therefore, there is a substantial need in the art for an improved bracket within a deflector assembly that does not require nailing or gluing the deflector assembly to the roof.

SUMMARY OF INVENTION

As noted in the aforementioned patents, the problems and annoyances involved in keeping rain gutters clean and free-flowing are common knowledge. However, the prior art solutions of screens, mesh, and deflectors for covering a gutter present other problems which in some ways are more burdensome and costly to install than simply periodically cleaning the gutters by hand. Not only do the screens and mesh materials themselves become clogged and blocked, but debris still collects within the gutter, necessitating removal of the screen or mesh before being able to reach the interior of the gutter for cleaning.

One object of the present invention is to provide an assembly that covers the gutter and prevents it from becoming clogged with leaves and other debris as well as protect the roof-line from ice and snow damage. The deflector assembly of this invention is designed as two integral units so that leaves, for example, and other debris which may clog the gutter, can neither enter the gutter or clog the deflector, the opening in the deflector that permits rain water to pass into gutter being horizontally disposed.

Another object of the present invention is to provide a deflector that can be easily installed by the average unskilled person.

Still another object of the present invention is to provide a deflector assembly that is stationary without using fasteners or glue strips to attach the assembly to the roof.

Another object of the present invention is to improve the ease with which deflector brackets are fastened to the gutter.

In accordance with my invention, I provide a deflector assembly for a rain gutter that forms a protective covering which can be installed on existing gutters in such a way that no fastening devices are required on a roof to hold the assembly in place, that can be easily installed generally by one unskilled person, and that can be easily removed and replaced without damaging roofing or guttering.

More specifically, my invention includes a unitary sheet of material, such as aluminum or vinyl, in the form of a deflector and a bracket for supporting the deflector. This unitary sheet includes an extended flat portion which does not contain any apertures therein, which functions as a closed-top portion for covering the open top of the existing gutter and which also serves to interfit under and between existing roof materials, such as roof shingles. Interfitting the flat portion under and between the existing roof materials securely fastens the invention to the roof as well as to provide an uninterrupted smooth path for rain water to travel off the roof and onto the flat top portion. The flat top portion is connected in the front thereof to an arcuate surface for directing rain water downward and inward toward the gutter. A triangular-shaped bracket, herein referred to as a rear mount bracket, is mounted on the rear wall of the gutter. The bracket extends forward and interfits with the arcuate portion of the unitary sheet described above. Where it is impractical to mount the bracket on the rear wall of the gutter because of roofing that may block access, an alternative bracket is formed to interfit with the arcuate portion of the unitary sheet described above and the underside of the front lip of the gutter. This alternative form of bracket is referred to as a gutter mount bracket.

The unitary sheet described above is of a predetermined length of approximately 3 feet. These unitary sheets have openings on both ends for installation of fasteners such as screws, rivets, or tabs to hold the flat portion of the sheet to the bracket. The openings in the flat unitary sheet are such that the unitary sheets can be overlapped to provide a continuous surface. Larger openings are also provided in the flat portion of each sheet such that fasteners already installed to a first unitary sheet can protrude without causing the flat portion of the adjacent sheet to buckle. This provides an installer with the ability to easily install one unitary sheet at a time to the bracket rather than having to install both sheets to the bracket simultaneously in order to properly fit the deflectors to the existing rain gutters.

The brackets, constructed of metal or plastic, have a flat slotted portion of significant length of approximately 1" that underfits the unitary sheet described above to accept fasteners. The slotted portion allows an installer to adjust the position of the unitary sheet to accommodate either style of bracket. The rear mount bracket can be made of several connecting pieces or it can be made of one continuous piece mounted on the back upper edge of the gutter. The rear mount bracket is triangular in shape having a mounting plate, a bracing member and a deflector support member, The mounting plate extends downward several inches towards the bottom of the gutter and is attached to the rear wall of the gutter. Extending from a top end of the mounting plate, the deflector support member extends to interfit with the arcuate portion of the deflector. The bracing member extends from an end of the deflector support member back to the lower end of the mounting plate where it is affixed to one of several prelocated slots.

The gutter lip mounting bracket interfits the arcuate portion of the deflector, extends downward and inward towards the inside portion of the top front lip of the gutter at which point it is formed to fit directly under a horizontal portion of a top lip of the gutter. The bracket is slotted at this juncture to accept screws or rivets, installed vertically from the top center portion of the front lip of the gutter. The slotted feature of the bracket enables the installation work to be safely accomplished 'blind' from a ladder or the roof since the slotted portion of the bracket can easily receive a screw or fastener extending from the top of the lip. The feature also allows the bracket to be installed to the front lip of the gutter before the deflector is installed. The deflector is then attached to the bracket and supported thereby.

BRIEF DESCRIPTION OF THE DRAWINGS

These as well as further objects and advantages of the invention will become apparent to those skilled in the art from a review of the following detailed specifications of my invention, reference being made to the accompanying drawings in which: embodiment of my invention:

FIG. 4 is a top view of the preferred embodiment of

To facilitate understanding, identical reference numerals have been used, where possible, to designate identical elements that are common to the figures.

DETAILED DESCRIPTION OF THE INVENTION

Figure 1:
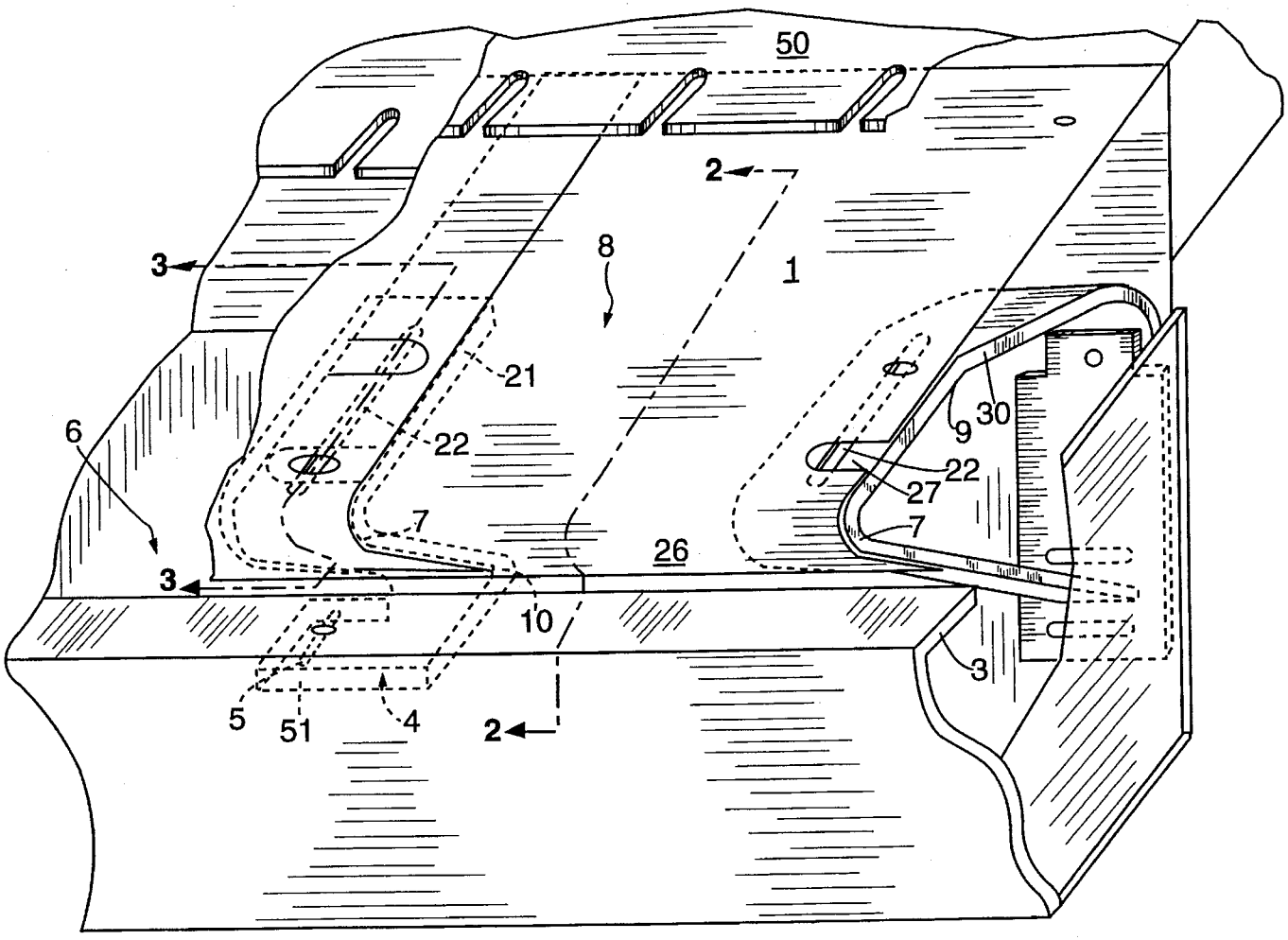
FIG. 1 is a perspective view of the preferred embodiment of my invention.
Figure 2:
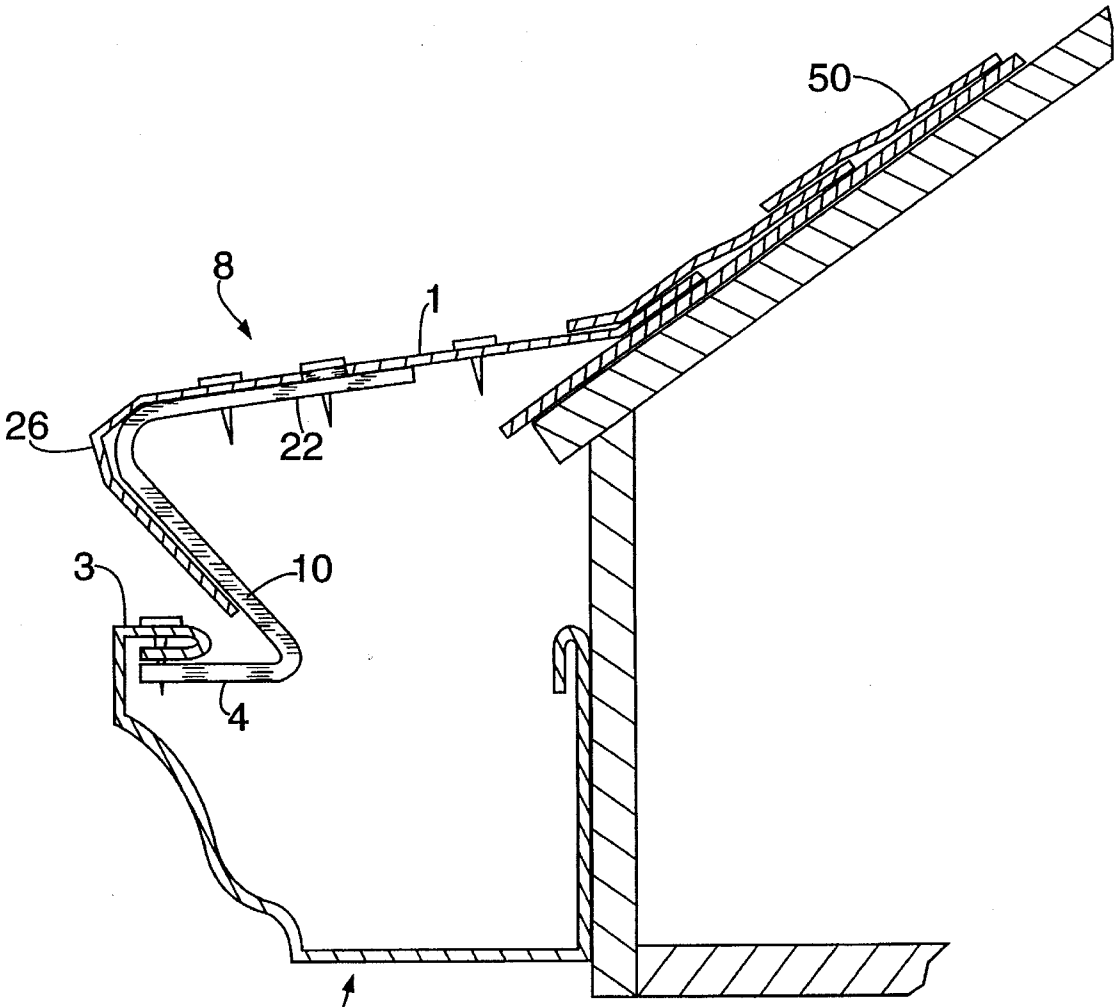
FIG. 2 is a sectional view of the preferred embodiment of my invention taken along the line 2—2 of FIG. 1.

FIG. 1 is a perspective view of a preferred embodiment of my invention and FIG. 2 is a cross-sectional view taken along line 2—2 in FIG. 1. In FIG. 1, an existing rain gutter (6) of the usual type is attached to a building adjacent to a roof (50). This gutter (6) usually has an open top as shown in the left-hand portion of FIG. 1.

In accordance with my invention, a covering and deflector for the open rain gutter is shown generally at numeral (8). This deflector has a closed top portion (1) and an arcuate front portion (26). The arcuate front portion (26) interfits and affixes to an arcuate portion (7) of either a gutter lip mounting bracket (10) or the rear mount bracket (30).

Figure 5:
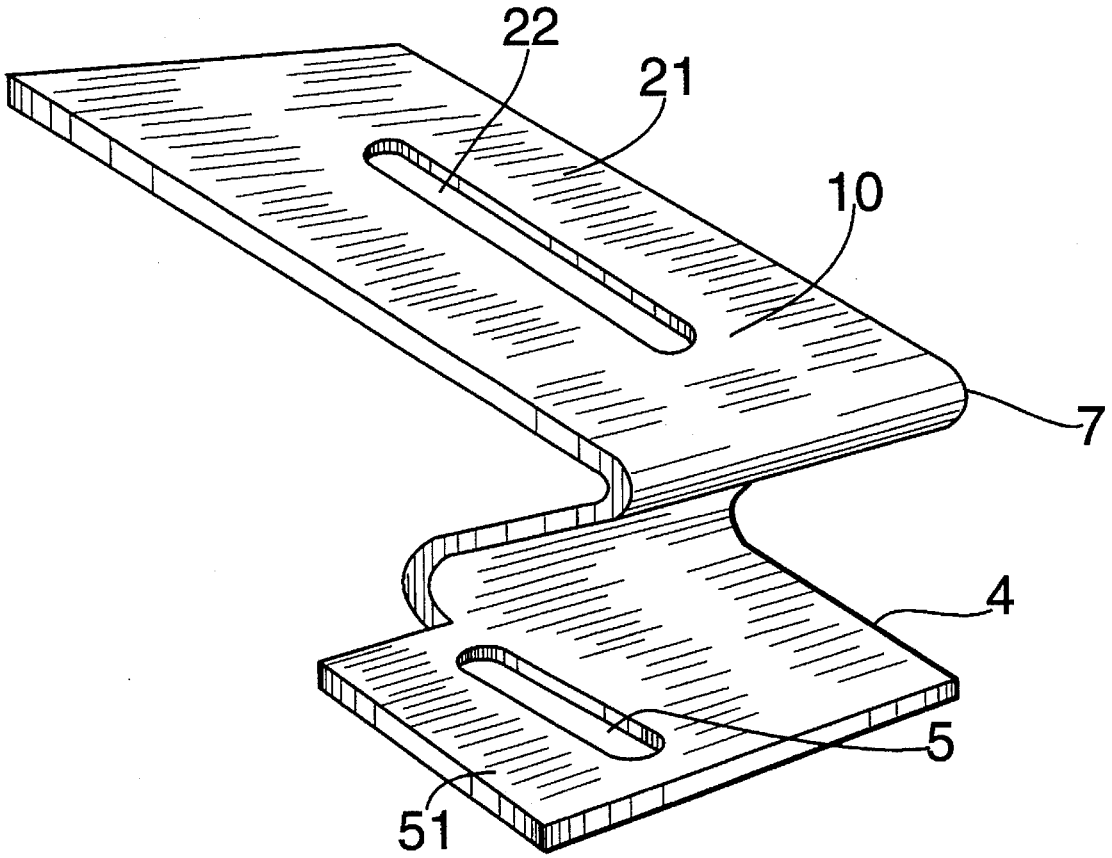
FIG. 5 is a perspective view of the preferred embodiment of the gutter lip mounting bracket shown in FIG. 1.

The gutter lip mounting bracket (10) connects to a bottom of a front lip (3) of the rain gutter (6). FIG. 5 shows a perspective view of the gutter lip mounting bracket (10) consisting of a lower portion (4) in which there is a slot (5) used to receive a fastener, e.g., a screw, rivet and the like. To attach the bracket (10) to the rain gutter, the fastener is installed through the front lip (3) of the rain gutter (6) into slot (5) of deflector gutter lip bracket (10). The deflector is attached to and supported by an upper portion (21) which contains a slot (22) that accepts fasteners. The upper portion (21) and lower portion (4) are connected to one another by an intermediate portion (7) having a generally arcuate form. When installed, the arcuate intermediate portion (7) interfits the inner diameter of the arcuate portion of the deflector. Importantly, to ease installation, the slot (5) of the deflector gutter lip bracket (10) is positioned in a extension member (51) that offsets the slot (5) from a centerline of the bracket, i.e., slot (22) is laterally offset from slot (5). As such, an installer has sufficient access to the slot (5) even though the intermediate portion (7) of the bracket may extend over the lower portion (4). Consequently, the present invention is much easier to install than prior art deflectors.

Figure 6:
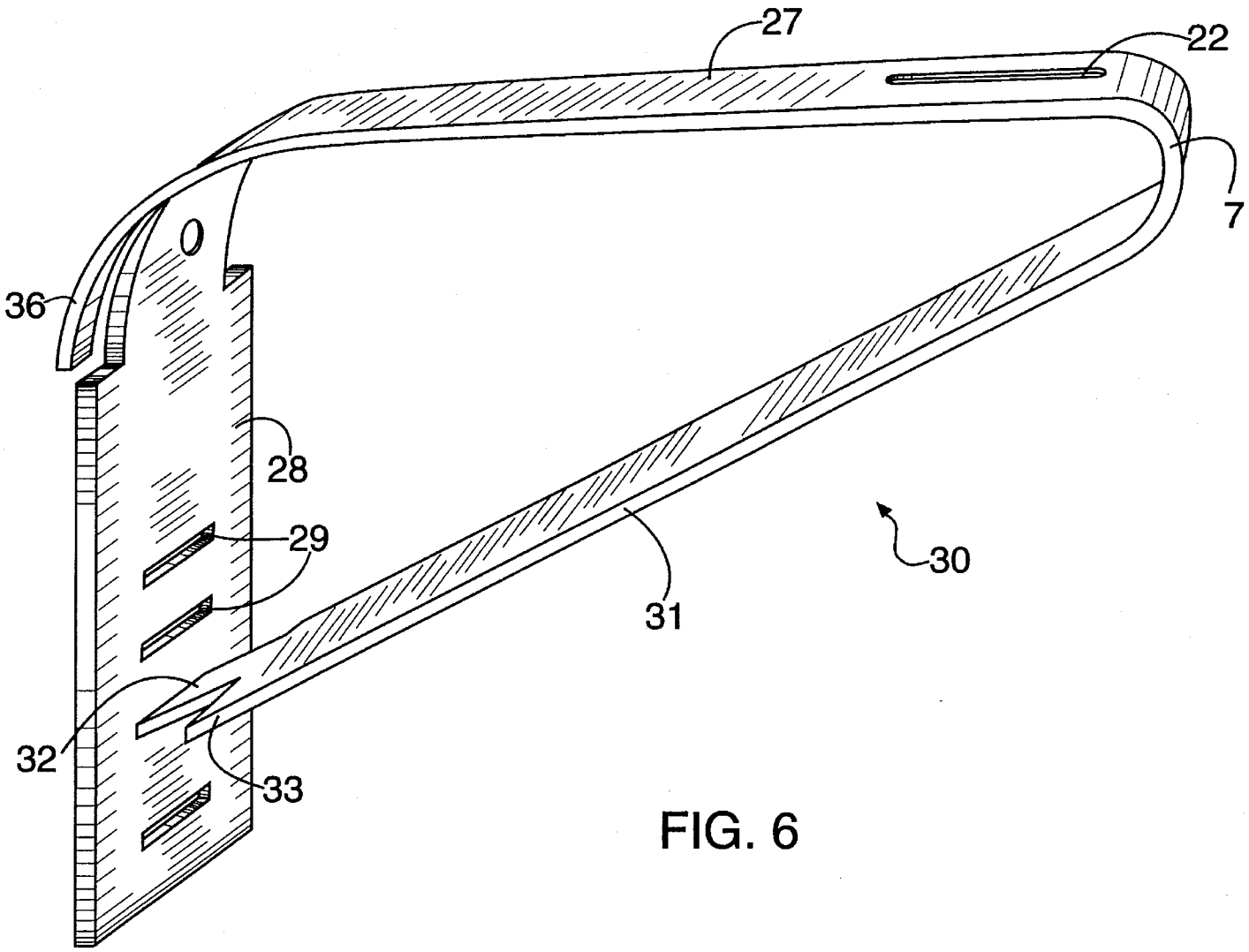
FIG. 6 is a perspective view of the preferred embodiment of the rear mount bracket shown in FIG. 1.

FIG. 6 depicts a perspective view of the rear mount bracket (30). Rear mount bracket (30) is used to mount against rear wall of gutter (6). The bracket is generally triangular in shape and contains a mounting plate (28), a bracing member (31) and a deflector support member (27). The bracket is typically constructed from a single piece of aluminum or steel. To facilitate mounting the,bracket to the rear wall of the gutter, upper stops or ears (36) extend from the mounting plate (28) and behind the top edge of the rear wall of gutter (6). Alternatively, using screws or other fasteners, the mounting plate can be fastened directly to the fascia boards of the building structure. Also, for added stability, both the ears and direct fastening can be used.

Receiving slots (29) in mounting plate (28) allow for adjustments in height of the arcuate portion (7) of the bracket and are fastened with tab (32) at one end of the bracing member (31). The bracing member contains stops (33) that make the bracing member stationary with respect to the mounting plate (28) Tab (32) of bracing member (31) extends through and beyond receiving slots (29) of mounting plate (28) by ¼ or more. The excess portion of the tab is bent down or twisted at time of installation to keep tab (32) from slipping or being knocked out of receiving slot (29). The deflector is attached to the deflector support member using fasteners through the deflector and into the slot (22). When attached, the arcuate portion (7) generally interfits the inner diameter of the arcuate portion of the deflector.

Figure 4:
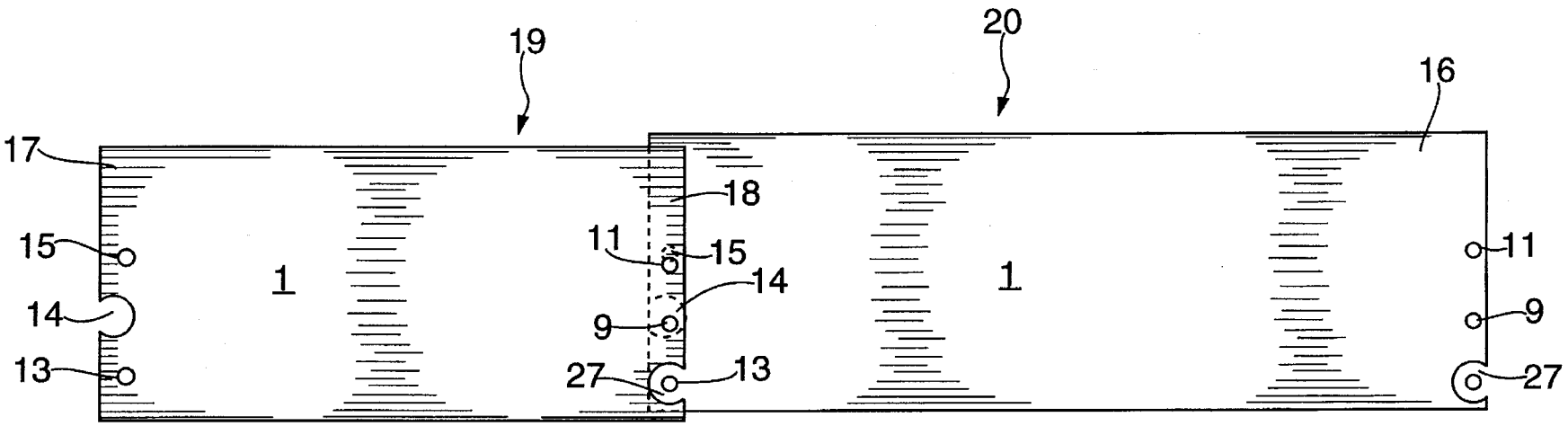

FIG. 4 shows a top view of the deflector assembly containing two deflectors (19) and (20). A top portion (16) of deflector (20) contains attachment apertures (27), (9), and (11) and top portion (17) of the deflector (19) contains attachment apertures (13), (14), and (15). To form a continuous covering over rain gutter, the top portion (16) of deflector (20) is joined with the top portion (17) of deflector (19) such that the top portions overlap as generally shown at (18) in FIG. 5.

Figure 3:
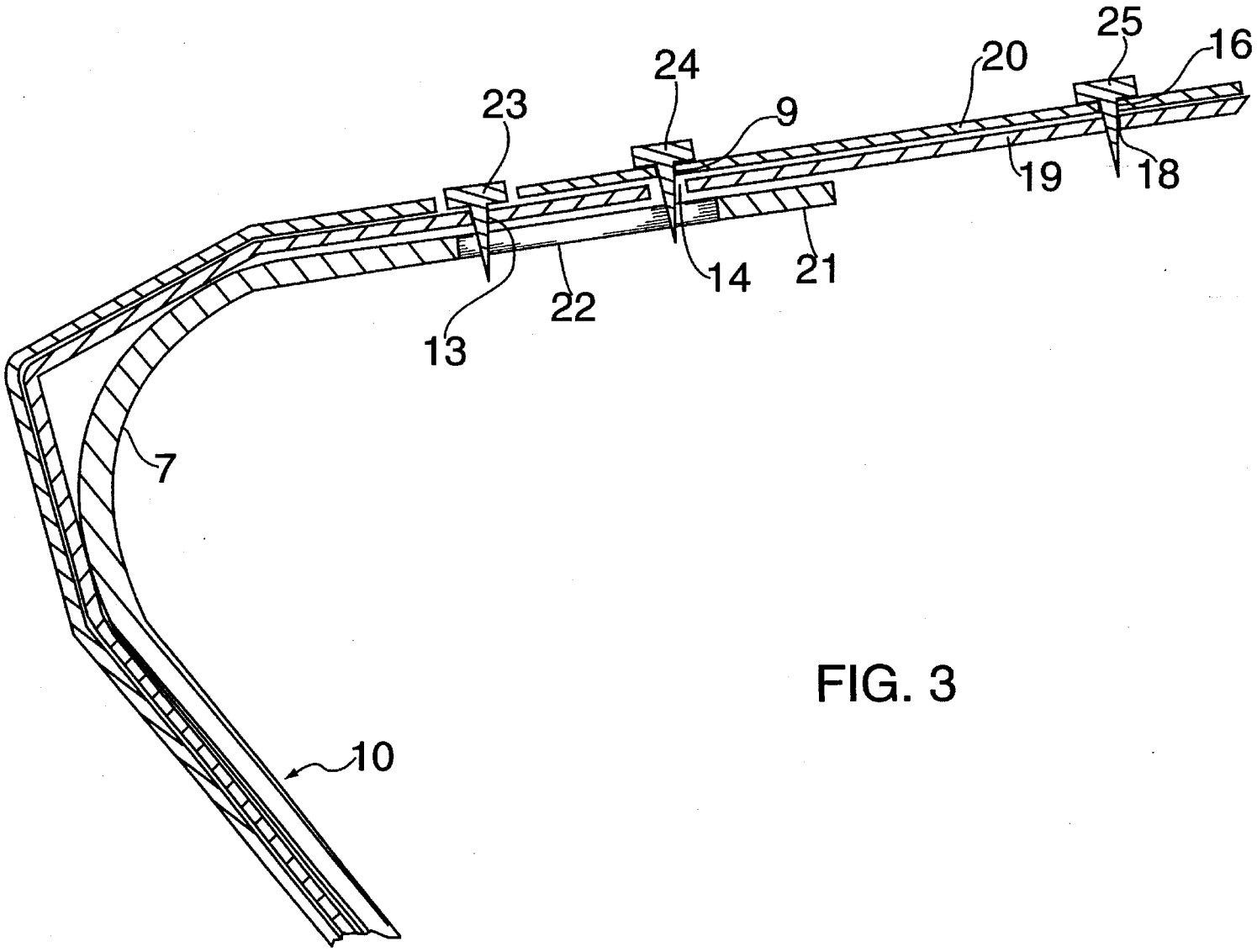
FIG. 3 is a partial sectional view of the preferred embodiment of my invention taken along the line 3—3 of FIG. 1; my invention of FIG. 1.

As shown in the cross-sectional view of FIG. 3, the right deflector (19) is initially fastened with fastener (23) through attachment aperture (13) and through slot (22) of top portion (21) of gutter lip mounting bracket (10). At the overlap juncture, left deflector (20) is laid over right deflector (19) and fastener (24) is installed through aperture (9) of deflector (20), aperture (14) of right deflector and through slot (22) of top portion (21) of gutter lip mounting bracket (10). Lastly, fastener (25) is positioned through apertures (16) and (18) of right deflector (20) and left deflector (19) respectively. Alternatively, a rear mount bracket could be used in lieu of the gutter lip mounting bracket.

Once the foregoing process is complete, the right (19) and left (20) deflectors are securely fastened to the gutter lip mounting bracket (10) by tightening the fasteners. If a rear mount bracket is used, slot (22) and arcuate portion (7) of rear mount bracket (30) (FIG. 6) are respectively analogous to slot (22) and arcuate portion (7) of gutter lip mounting bracket (FIG. 5). As such, once the brackets are installed, i.e., to the gutter lip for the gutter lip mounting bracket or the rear gutter wall for the rear mount bracket, the process for attaching the deflectors to either bracket is identical.

Although various embodiments which incorporate the teachings of the present invention have been shown and described in detail herein, those skilled in the art can readily devise many other varied embodiments that still incorporate these teachings.

I claim:

1. An improved rain gutter deflector assembly comprising:

a top portion for extending from a roof line and having a distal edge located over a rain gutter;

an arcuate portion, formed along said distal edge of said top portion and extending toward said rain gutter, having a curvature for carrying rain water from said top portion into said rain gutter;

a bracket, attached between said top portion and said rain gutter, for supporting said top portion above said rain gutter; and said top portion having a first end and a second end each containing two attachment apertures proximate thereto, a first attachment aperture having a smaller diameter than a second attachment aperture, said top portion being attached to said bracket using said first attachment aperture.

2. The deflector assembly of claim 1 wherein said second attachment aperture is a slot extending to an end of said top portion.

3. The deflector assembly of claim 1 further comprising a second top portion having the same form as said first top portion and mounted adjacent said first top portion, such that said second attachment aperture of said second top portion overlaps said first attachment aperture of said first top portion.

4. The deflector assembly of claim 3 further comprising a third attachment aperture, located proximate the ends of said first and second top portions, for fastening, by inserting a fastener through the third attachment aperture, said first top portion to said second top portion.

5. The deflector assembly of claim 1 wherein said bracket further comprises:

an upper bracket portion for supporting said top portion of said deflector assembly and for attachment to said top portion;

a lower bracket portion for extending beneath the lip of said gutter and for attachment thereto; and an intermediate bracket portion for interconnecting said bottom portion and said top bracket portions.

6. The deflector assembly of claim 5 wherein said top, bottom and intermediate portions are formed from a single elongated piece of material.

7. The deflector assembly of claim 5 wherein said intermediate portion has an arcuate shape that substantially conforms to the shape of the arcuate portion of the deflector assembly.

8. The deflector assembly of claim 7 wherein said first attachment aperture is aligned with an attachment aperture in said upper bracket portion of said bracket such that said top portion of said deflector assembly is securely attached to said bracket using a fastener.

9. The deflector assembly of claim 8 wherein said attachment aperture in said upper bracket portion is an elongated slot.

10. The deflector assembly of claim 8 wherein said lower bracket portion further comprises an elongated slot for affixing said bracket to said gutter lip using a fastener.

11. The deflector assembly of claim 10 wherein said lower bracket portion further comprises an extension member having said elongated slot located therein such that said elongated slot is laterally offset from said attachment aperture in said upper bracket portion.

12. The deflector assembly of claim 1 wherein said bracket further comprises:

a deflector support portion for supporting and attaching said bracket to said top portion of said deflector assembly;

a mounting plate, attached to a first end of said deflector support portion, for attaching said bracket to a fascia board or a rear wall of said rain gutter; and a bracing member attached between said mounting plate and a second end of said deflector support portion.

13. The deflector assembly of claim 12 wherein said bracket is formed from a single piece of material.

14. The deflector assembly of claim 12 wherein said mounting plate further comprises a plurality of vertically-arranged receiving slots, one of which interfits with an end of said bracing member, such that the height of said top portion of said deflector assembly above the rain gutter is adjustable by selecting one of said plurality of receiving slots.

15. The deflector assembly of claim 12 wherein said mounting plate further comprises one or more ears interfitting a top edge of said rear wall of said rain gutter.

16. The deflector assembly of claim 12 wherein said top bracket portion, at said end that attaches to said bracing member, has an arcuate shape that conforms to said arcuate portion of said deflector assembly and interfits said arcuate portion.

17. The deflector assembly of claim 12 wherein said deflector support portion further comprises an elongated slot aligned with said first attachment aperture in said top bracket portion.

18. A bracket comprising:

an upper bracket portion for supporting a deflector assembly;

a substantially horizontal lower bracket portion for extending beneath a lip of a rain gutter and for attachment thereto, wherein said lower bracket portion further comprises an extension member having an attachment aperture located therein, where said attachment aperture is used for coupling said lower bracket portion to said lip of said gutter; and an intermediate bracket portion for interconnecting said lower bracket portion and said upper bracket portion, where said intermediate bracket portion extends partially over said lower bracket portion and where said attachment aperture is laterally offset from said intermediate bracket portion.

19. A bracket comprising:

an upper bracket portion for supporting a deflector assembly; wherein said deflector assembly further comprises a top portion for extending from a roof line and having a distal edge located over a rain gutter, an arcuate portion, formed along said distal edge of said top portion and extending toward said rain gutter, having a curvature for carrying rain water from said top portion into said rain gutter, said top portion having a first end and a second end each containing two attachment apertures therein, a first attachment aperture having a smaller diameter than a second attachment aperture, said top portion being attached to said bracket using said first attachment aperture;

a lower bracket portion for extending beneath a lip of a rain gutter and for attachment thereto; and an intermediate bracket portion for interconnecting said lower bracket portion and said upper bracket portion.

20. The bracket of claim 19 wherein said intermediate portion has an arcuate shape that substantially conforms to the shape of the arcuate portion of the deflector assembly.

21. The bracket of claim 19 wherein said first attachment aperture is aligned with an attachment aperture in said upper portion of said bracket such that said upper portion of said deflector assembly is securely attached to said bracket using a fastener.

22. The bracket of claim 21 wherein said attachment aperture in said upper bracket portion is an elongated slot.

23. The bracket of claim 21 wherein said lower bracket portion further comprises an elongated slot for affixing said bracket to said gutter lip using a fastener.

24. The bracket of claim 23 wherein said lower bracket portion further comprises an extension member having said elongated slot located therein such that said elongated slot is laterally offset from said attachment aperture in said upper bracket portion.

25. A bracket comprising:

a deflector support portion for supporting and attaching a deflector assembly to a rain gutter; wherein said deflector assembly further comprises a top portion for extending from a roof line and having a distal edge located over said rain gutter, an arcuate portion, formed along said distal edge of said top portion and extending toward said rain gutter, having a curvature for carrying rain water from said top portion into said rain gutter, and said top portion having a first end and a second end each containing two attachment apertures thereto, the first attachment aperture having a smaller diameter than a second attachment aperture, said top portion being attached to said bracket using said first attachment aperture;

a mounting plate, attached to a first end of said deflector support portion, for attaching said bracket to a fascia board or a rear wall of said rain gutter; and a bracing member attached between said mounting plate and a second end of said deflector support portion.

26. The bracket of claim 25 wherein said rear bracket portion further comprises one or more ears interfitting a top edge of said rear wall of said rain gutter.

27. The bracket of claim 25 wherein said deflector support portion, at said end that attaches to said bracing member, has an arcuate shape that conforms to said arcuate portion of said deflector assembly and interfits said arcuate portion thereof.

28. The bracket of claim 25 wherein said deflector support portion further comprises an elongated slot aligned with said first attachment aperture in said top bracket portion.

29. A bracket comprising:

a deflector support portion for supporting and attaching a deflector assembly to a rain gutter;

a mounting plate, attached to a first end of said deflector support portion, for attaching said bracket to a fascia board or a rear wall of said rain gutter, wherein said mounting plate further comprises a plurality of vertically-arranged receiving slots, one of which interfits with an end of said bracing member, such that the height of said top portion of said deflector assembly above the rain gutter is adjustable by selecting one of said plurality of receiving slots; and a bracing member attached between said mounting plate and a second end of said deflector support portion.

* * * * *